US010328693B2

(12) United States Patent
Klerken et al.

(10) Patent No.: US 10,328,693 B2
(45) Date of Patent: Jun. 25, 2019

(54) FLUID JETTING DEVICE, PRINTING APPARATUS, AND METHOD THEREFOR

(71) Applicant: Océ Holding B.V., Venlo (NL)

(72) Inventors: Pierre A. M. Klerken, Venlo (NL); Johannes M. M. Simons, Venlo (NL); Ralph Van Der Heyden, Venlo (NL)

(73) Assignee: OCÉ HOLDING B.V., Venlo (NL)

( * ) Notice: Subject to any disclaimer, the term of this patent is extended or adjusted under 35 U.S.C. 154(b) by 0 days.

(21) Appl. No.: 16/034,732

(22) Filed: Jul. 13, 2018

(65) Prior Publication Data

US 2018/0319159 A1 Nov. 8, 2018

Related U.S. Application Data

(63) Continuation of application No. PCT/EP2017/050873, filed on Jan. 17, 2017.

(30) Foreign Application Priority Data

Jan. 21, 2016 (EP) ..... 16152237

(51) Int. Cl.
*B41J 2/045* (2006.01)

(52) U.S. Cl.
CPC ..... *B41J 2/04588* (2013.01); *B41J 2/04551* (2013.01); *B41J 2/04573* (2013.01); *B41J 2/04581* (2013.01); *B41J 2/04596* (2013.01)

(58) Field of Classification Search
CPC ..... B41J 2/04588; B41J 2/04551; B41J 2/04573; B41J 2/04581; B41J 2/04596
See application file for complete search history.

(56) References Cited

U.S. PATENT DOCUMENTS 4,369,455 A 1/1983 McConica et al.
6,305,773 B1 * 10/2001 Burr ..... B41J 2/04581 347/10

(Continued)

FOREIGN PATENT DOCUMENTS

EP 0 105 156 A2 4/1984

OTHER PUBLICATIONS

International Search Report (PCT/ISA/210) issued in PCT/EP2017/050873, dated Mar. 30, 2017.

(Continued)

*Primary Examiner* — Jason S Uhlenhake
(74) *Attorney, Agent, or Firm* — Birch, Stewart, Kolasch & Birch, LLP

(57) ABSTRACT

Fluid jetting device comprising: a nozzle plate, a fluid chamber terminating in an orifice in the nozzle plate, an actuator for generating a pressure wave in a fluid in the fluid chamber to jet fluid through the orifice from the chamber, a jetting waveform generating device connected to the actuator for generating an excitation waveform comprising two separated pulses, called a jetting pulse and a quenching pulse, for respectively generating a pressure wave in the fluid in the fluid chamber leading to a fluid droplet and for substantially cancelling a pressure wave in the fluid in the fluid chamber, wherein the jetting waveform generating device is adapted to make, when jetting two consecutive fluid droplets, a first and a second droplet, the jetting pulse of the second droplet at least partially overlap the quenching pulse directly following the jetting pulse of the first droplet.

14 Claims, 5 Drawing Sheets

(56) References Cited

U.S. PATENT DOCUMENTS

| | | | | |
|---|---|---|---|---|
| 9,682,548 | B2 * | 6/2017 | Ohnishi | B41J 2/04588 |
| 2002/0089558 | A1 | 7/2002 | Suzuki et al. | |
| 2002/0101464 | A1 | 8/2002 | Iriguchi | |
| 2004/0239721 | A1 * | 12/2004 | Usuda | B41J 2/04581 347/40 |

OTHER PUBLICATIONS

Search Report issued in European Patent Application No. 16 15 2237, dated Jul. 1, 2016.
Written Opinion (PCT/ISA/237) issued in PCT/EP2017/050873, dated Mar. 30, 2017.

* cited by examiner

FLUID JETTING DEVICE, PRINTING APPARATUS, AND METHOD THEREFOR

CROSS-REFERENCE TO RELATED APPLICATIONS

This application is a Continuation of PCT International Application No. PCT/EP2017/050873, filed on Jan. 17, 2017, which claims priority under 35 U.S.C. 119(a) to patent application Ser. No. 16/152,237.0, filed in Europe on Jan. 21, 2016. The above-identified applications are hereby expressly incorporated by reference into the present application.

BACKGROUND OF THE INVENTION

1. Field of the Invention

The present invention generally pertains to generating suitable waveforms for driving an actuator in a fluid jetting device.

2. Description of the Related Art

In fluid jetting devices such as print heads used in printers, a fluid such as ink is contained in a chamber. The chamber comprises an orifice in one of its walls through which a droplet of fluid is to be jetted out of the fluid jetting device. In general fluid is caused to be jetted by generating a pressure wave in the fluid by means of a suitable actuator. Commonly known actuators are piezoelectric actuators and thermal actuators. By driving the actuator according to a suitable waveform a pressure wave is generated in the fluid, forcing a droplet to be jetted through the orifice. The driving waveform comprises a pulse to cause the jetting of a droplet. This pulse is known as the jetting pulse.

After a droplet of fluid has been jetted, the pressure wave in the fluid has not disappeared. It will take some time for the pressure wave to dampen out. If two droplets are to be jetted close enough in time, the pressure wave of the first droplet might interfere with the actuation of the second droplet causing deviations in the timing of the jetting, the jetted volume, and the jetting velocity of the second droplet. In for example inkjet printers, this will result in poor image quality due to inaccurate placement of ink dots on the print media and varying dot sizes.

It is known to mitigate this effect by actually generating a subsequent actuation after the first droplet has been jetted, but before the second droplet is to be jetted which subsequent actuation negatively contributes to the oscillatory energy of the pressure wave generated by the first actuation to jet the first droplet. Such subsequent actuation to forcedly 'dampen' the pressure wave is achieved by having the actuation waveform comprise what is known as a quench pulse.

The timing of the driving waveform, particularly the length of the jetting pulse and of the quench pulse, the time between the jetting pulse and the quench pulse as well as—but to a minor degree—the time between the quench pulse and a jetting pulse of a consequent droplet to be jetted, is determined by the physical dimensions of the fluid chamber and the physical properties of the fluid. The timing can therefore not be freely chosen. This puts restrictions on the jetting frequency of the fluid jetting device and the number of droplets per second that can be jetted.

A disadvantage of the known fluid jetting devices is that there is a compromise between productivity on the one hand and jetting accuracy/quality on the other hand. It is an object of the present invention to improve on this compromise.

SUMMARY OF THE INVENTION

In a first aspect of the present invention, a fluid jetting device is provided, comprising: a nozzle plate, a fluid chamber terminating in an orifice in the nozzle plate, an actuator for generating a pressure wave in a fluid in the fluid chamber to jet fluid through the orifice from the chamber, a jetting waveform generating device connected to the actuator for generating an excitation waveform, the jetting waveform generating device adapted to generate: a jetting pulse for generating a pressure wave in the fluid in the fluid chamber, and a quenching pulse for substantially cancelling a pressure wave in the fluid in the fluid chamber, wherein, when jetting two consecutive fluid droplets, the jetting pulse of the second droplet at least partially overlaps the quenching pulse directly following the jetting pulse of the first droplet.

In contrast to the prior art where the jetting pulses and the quench pulses are distinct pulses that can be distinguished from each other, in the present invention the quench pulse of a first droplet at least partially overlaps in time with the jetting pulse of a consecutive second droplet. During experiments applicant determined that overlapping the quench pulse of the first droplet with the jetting pulse of a consecutive droplet still causes the second droplet to be jetted. The timing accuracy and the jetting velocity of the second droplet were even on a level coming close to a situation as known from the prior art wherein after the first jetting pulse has jetted a first droplet, a first quench pulse is provided to the actuator to at least partially cancel the pressure wave in the pressure chamber and only after the first quench pulse has completed, providing a second jetting pulse to jet the second droplet.

The timing accuracy and jetting velocity are much better than the prior art systems where no quench pulses are applied.

The present invention allows for a fluid jetting device with a productivity (in terms of jetting frequency) equal to the case where no quench pulses are applied, but with a quality (in terms of timing accuracy of jetting and jetting velocity) that comes much closer to the case of non-overlapping quench and jetting pulses.

In a further aspect of the invention a fluid jetting device is provided, wherein, when jetting two consecutive fluid droplets, the jetting pulse of the second droplet substantially coincides with the quenching pulse directly following the jetting pulse of the first droplet. In an even further aspect a fluid jetting device is provided, wherein the leading edge of the quenching pulse directly following the jetting pulse of the first droplet substantially coincides with the leading edge of the jetting pulse of the second droplet, and/or the trailing edge of the quenching pulse directly following the jetting pulse of the first droplet substantially coincides with the trailing edge of the jetting pulse of the second droplet. Increasing the amount of overlap between the quench pulse and jetting pulse increases the energetical efficiency of the fluid jetting process. In the ideal case, the leading edges of the quench pulse and jetting pulse coincide, as well as the trailing edges of the quench pulse and jetting pulse.

In another aspect of the present invention a fluid jetting device is provided, wherein: the leading edge of the quenching pulse directly following the jetting pulse of the first droplet occurs before the leading edge of the jetting pulse of the second droplet, and the trailing edge of the quenching pulse directly following the jetting pulse of the first droplet occurs after the trailing edge of the jetting pulse of the second droplet.

In a particular aspect of the present invention a fluid jetting device is provided, wherein the jetting pulse comprises multiple sub-pulses, each sub-pulse contributes positively to the oscillatory energy of the fluid in the fluid chamber but only the last sub-pulse causes the actual jetting of fluid through the orifice from the chamber.

In another aspect of the invention a fluid jetting device is provided, wherein: the jetting waveform generating device comprises: a jetting pulse waveform generator, and a quench pulse waveform generator, and wherein the fluid jetting device is configured to generate a combined quenching pulse of a first droplet and jetting pulse of a second droplet by superimposing a quenching pulse from the quench pulse waveform generator and a jetting pulse from the jetting pulse waveform generator.

In a specific aspect of the invention a fluid jetting device is provided, wherein the fluid jetting device comprises a print head. The print head may be adapted for printing images on a media. Alternatively, the print head may be adapted to print a 3-dimensional workpiece by jetting fluid droplets and solidifying the droplets into a solid workpiece, for example by curing. Generally, the print head comprises an array of fluid jetting devices in order to simultaneously jet multiple droplets in multiple locations. In an even more specific aspect of the invention a printer apparatus is provided comprising such a print head.

In one specific aspect of the invention a printer apparatus is provided, wherein the jetting waveform generating device is not comprised in the print head, but is external to it, and wherein a waveform generated and output by the jetting waveform generating device is input to the print head that is connected to the jetting waveform generating device.

According to another aspect of the invention a printing apparatus is provided that is operable in at least two operational modes: a first operational mode being a high speed mode, wherein, when jetting two consecutive fluid droplets, the jetting pulse of the second droplet at least partially overlaps the quenching pulse directly following the jetting pulse of the first droplet; and a second operational mode being a quality print mode, wherein, when jetting two consecutive fluid droplets, the jetting pulse of the second droplet starts after the quenching pulse directly following the jetting pulse of the first droplet, has completed.

The high speed mode may correspond to the highest jetting frequency allowed by the pressure chamber acoustical properties. By overlapping the jetting pulse for a second droplet with the quench pulse of a first droplet, the second droplet can be jetted earlier than compared to non-overlapping quench and jetting pulses. However, because a quench pulse is still being generated, the jetting quality is much higher than in the prior art cases that lack quench pulses for each jetted droplet.

In the quality mode, the jetting pulse for the second droplet is not started before the quench pulse of the first droplet has completed. Although this mode allows for a slightly higher jetting quality, the jetting frequency and therewith the jetting productivity reduces significantly. The high speed mode jets at 78 kHz instead of 53 kHz, which is an increase of 47%.

In another aspect of the present invention a method for jetting a fluid from a fluid jetting device is provided, the fluid jetting device comprising: a nozzle plate, a fluid chamber terminating in an orifice in the nozzle plate, an actuator for generating a pressure wave in a fluid in the fluid chamber to jet fluid through the orifice from the chamber, a jetting waveform generating device connected to the actuator for generating an excitation waveform, the method comprising the steps of: the jetting waveform generating device generating, if during a first jetting cycle a first droplet of fluid is to be jetted and during a consecutive second jetting cycle no droplet of fluid is to be jetted: during the first jetting cycle a jetting pulse for generating a pressure wave in the fluid in the fluid chamber, and during the second jetting cycle a quenching pulse for substantially cancelling a pressure wave in the fluid in the fluid chamber, if during a first jetting cycle a first droplet of fluid is to be jetted as well as during a consecutive second jetting cycle: during the first jetting cycle a first jetting pulse for generating a pressure wave in the fluid in the fluid chamber, and during the second jetting cycle a second jetting pulse as well as a first quenching pulse, wherein the second jetting pulse at least partially overlaps the first quenching pulse.

In a further aspect of the present invention a method is provided, wherein the second jetting pulse substantially coincides with the first quenching pulse.

In an even further aspect of the present invention a method is provided, wherein the leading edge of the first quenching pulse substantially coincides with the leading edge of the second jetting pulse, and the trailing edge of the first quenching pulse substantially coincides with the trailing edge of the second jetting pulse.

The present invention also provides a method, wherein: the leading edge of the first quenching pulse occurs before the leading edge of the second jetting pulse, and the trailing edge of the first quenching pulse occurs after the trailing edge of the second jetting pulse.

Furthermore, the present invention provides a method, wherein: the jetting waveform generating device comprises: a jetting pulse waveform generator, and a quench pulse waveform generator, and wherein the method further comprises the step of: the fluid jetting device superimposing the second jetting pulse and the first quenching pulse, and therewith generating a combined jetting and quenching pulse.

According to another aspect of the present invention, a method is provided, wherein the fluid jetting device is operable in at least two operational modes: a first operational mode being a high speed mode, wherein, when jetting two consecutive fluid droplets, the jetting pulse of the second droplet at least partially overlaps the quenching pulse directly following the jetting pulse of the first droplet; and a second operational mode being a quality print mode, wherein, when jetting two consecutive fluid droplets, the jetting pulse of the second droplet starts after the quenching pulse directly following the jetting pulse of the first droplet, has completed and wherein the jetting waveform generating device generates: in the high speed mode: if during a first jetting cycle a first droplet of fluid is to be jetted and during a consecutive second jetting cycle no droplet of fluid is to be jetted: during the first jetting cycle a jetting pulse for generating a pressure wave in the fluid in the fluid chamber, and during the second jetting cycle a quenching pulse for substantially cancelling a pressure wave in the fluid in the fluid chamber, if during a first jetting cycle a first droplet of fluid is to be jetted as well as during a consecutive second jetting cycle: during the first jetting cycle a first jetting pulse for generating a pressure wave in the fluid in the fluid chamber, and during the second jetting cycle a second jetting pulse as well as a first quenching pulse, wherein the second jetting pulse at least partially overlaps the first quenching pulse, and in the quality print mode: if during a first jetting cycle a first droplet of fluid is to be jetted and during a consecutive second jetting cycle no droplet of fluid is to be jetted: during the first jetting cycle a first jetting pulse for generating a pressure wave in the fluid in the fluid chamber followed by a first quenching pulse for substantially cancelling a pressure wave in the fluid in the fluid chamber, and during the second jetting cycle no jetting pulse and no quenching pulse, if during a first jetting cycle a droplet of fluid is to be jetted as well as during a consecutive second jetting cycle: during the first jetting cycle a first jetting pulse for generating a pressure wave in the fluid in the fluid chamber followed by a first quenching pulse for substantially cancelling a pressure wave in the fluid in the fluid chamber, and during the second jetting cycle a second jetting pulse for generating a pressure wave in the fluid in the fluid chamber followed by a second quenching pulse for substantially cancelling a pressure wave in the fluid in the fluid chamber.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying schematical drawings which are given by way of illustration only, and thus are not limitative of the present invention, and wherein.

DETAILED DESCRIPTION OF EMBODIMENTS

Figure 1:
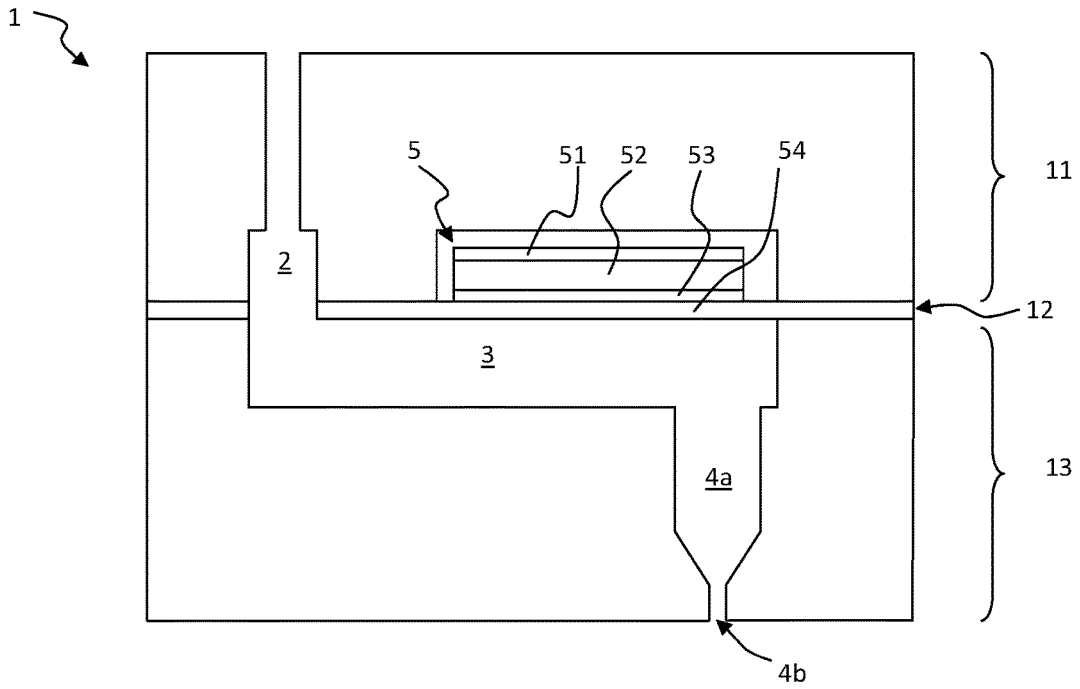
FIG. 1 shows a cross sectional view of a fluid jetting device according to the invention.

The present invention will now be described with reference to the accompanying drawings, wherein the same reference numerals have been used to identify the same or similar elements throughout the several views.

FIG. 1 shows an example of a design of a piezo-actuated inkjet print head 1. The inkjet print head 1 is formed by a three layered structure having a supply layer 11, a membrane layer 12 and an output layer 13. A fluid channel is composed of a supply channel 2, a pressure chamber 3, an output channel 4*a* and a nozzle orifice 4*b*. The membrane layer 12 comprises a piezo actuator 5. The piezo actuator is formed by a first electrode 51, a piezo material layer 52, a second electrode 53 and a membrane 54. The first electrode 51, the second electrode 53 and the piezo material layer 52 arranged therebetween together form the active piezo stack. Upon application of a voltage over the first electrode 51 and the second electrode 53, an electrical field is provided in the piezo material layer 52 and as a consequence the piezo material layer 52 contracts or expands, in the present embodiment in a direction parallel to the membrane 54. As the piezo material layer 52 is adhered to first electrode 51 and the second electrode 53 and indirectly to the membrane 54 and as at least the membrane 54 counteracts such contraction or expansion, the piezo actuator 5 deforms by bending as illustrated in and described in relation to FIG. 2 hereinbelow.

An actuation of the actuator generates a pressure wave in a fluid present in the fluid channel. The actuation and following pressure wave eventually induces a deformation of the piezo actuator 5 and a corresponding volume change in the fluid channel, in particular in the pressure chamber 3. Thus, a suitably designed print head and a suitably generated pressure wave will result in a droplet being expelled through the nozzle orifice 4*b*, as is well known in the art.

The supply layer 11 and the output layer 13 of the inkjet print head 1 may be formed from silicon wafers. The fluid channel may be formed in such silicon wafers by well known etching methods, for example. Using silicon wafers and etching techniques allows to generate relatively small structures such that a high density arrangement of nozzle orifices 4*b* may be obtained. Thus, it may be possible to manufacture an inkjet print head 1 having a nozzle arrangement of 600 or even 1200 nozzles per inch (npi) that may be used in a printer assembly for printing at 600 or 1200 dots per inch (dpi), respectively. In a high density arrangement of nozzle orifices 4*b*, there is of course also a high density of corresponding piezo actuators 5. When operating the inkjet print head 1 drive circuitry generates an amount of heat due to power dissipation. For freedom of design, the power dissipation should be kept to a minimum. Therefore, a high energy efficiency is needed. A high energy efficiency may be achieved by obtaining a high energy coupling coefficient, id est a coefficient indicating a ratio of energy effectively used and energy input into the system. In the field of piezo actuated inkjet print heads, an energy coupling coefficient of the electrical energy input and the energy effectively applied to the fluid, id est the acoustic energy, should be maximized for obtaining a high energy efficiency. Suitably designing the inkjet print head 1 enables to obtain a high energy coupling coefficient.

Figure 2:
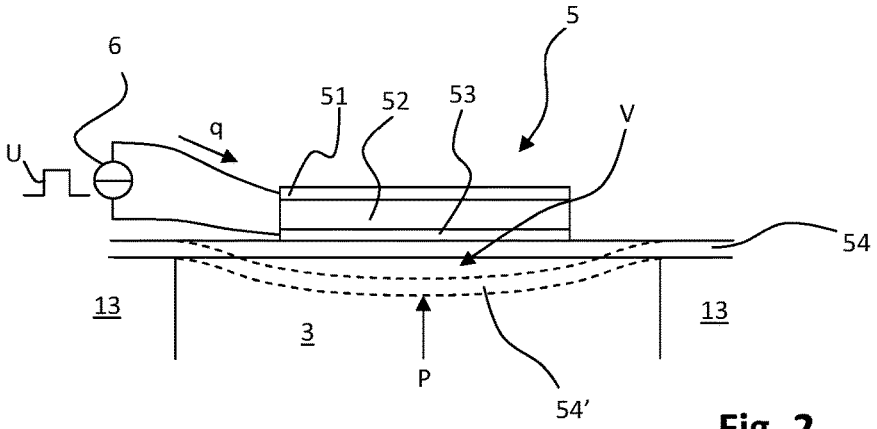
FIG. 2 shows a cross sectional view of the actuator of the fluid jetting device of FIG. 1.

FIG. 2 shows the actuator 5 of the inkjet print head 1 of FIG. 1 in more detail. A drive voltage source 6 is connected between the first electrode 51 and the second electrode 53. The drive voltage source 6 is configured for supplying a drive voltage U. The active piezo stack functions electrically as a capacitor and consequently an electrical charge q will be supplied to the piezo actuator 5 upon supply of the drive voltage U. Due to the piezo properties of the piezo material layer 52 in response to the electrical field between the first electrode 51 and the second electrode 53, the actuator 5 will deform resulting in the bent shape of the membrane 54' (dashed). It is noted that the active piezo stack will of course deform too and remain on the membrane 54, but for clarity reasons the deformed active piezo stack is omitted in FIG. 2. Due to the deformation, a volume change V results in the pressure chamber 3. The fluid in the pressure chamber 3 exerts a pressure P.

FIGS. 3-6 show example waveforms for driving the actuator. Although such a waveform can have many shapes, the waveforms shown in here are all piecewise linear waveforms. The drive voltage source 6 generates a voltage that varies over time as shown by the waveform depicted schematically in FIG. 3. When a nozzle is idle the voltage is usually at a reference value. In the drawings depicting the waveforms for the driving signal, the reference value will be shown as 0 V for simplification of these drawings, although the real reference value will usually have another value. In some embodiments the drive voltage source will comprise switches for switching the drive voltage source output to a high impedance state. As a piezoelectric actuator 5 is a capacitance from an electrical point of view, switching the drive voltage source 6 to a high impedance output state will maintain the voltage over the piezo actuator 5 and will therefore maintain any deformed state if present. In a high impedance output state any voltage generated internally in the drive voltage source 6 is irrelevant.

In order to jet a droplet from the nozzle orifice 4*b* the drive voltage source 6 ramps up the voltage U supplied to the actuator 5 as shown at relative time 0. During the rising edge of the waveform, the actuator 5 will deform and increase the volume of the pressure chamber 3. The increase in volume will cause a negative pressure wave front spreading through the pressure chamber 3 resulting in fluid entering the pressure chamber 3 through the supply channel 2. Then the voltage over the actuator 5 is maintained (either by maintaining the voltage by means of the drive voltage source 6, or alternatively by switching to a high impedance output state) in order to allow fluid to enter the pressure chamber 6 and further to await the appropriate time for expelling fluid through the nozzle orifice 4*b*. Shortly before the 5 μs mark in FIG. 3, the drive voltage source 6 ramps down the voltage, causing the actuator 5 to deform and decrease the volume of the pressure chamber 3. This causes a pressure wave to propagate through the pressure chamber resulting in a droplet being jetted out of the nozzle orifice 4*b*. The positive pulse running from time 0 till slightly after 5 μs in the waveform in FIG. 3 is known as the jetting pulse as it actually causes a droplet to be jetted out of the nozzle orifice 4*b*.

The pressure wave that was generated by the jetting pulse does not immediately disappear after a droplet has been jetted. Instead the pressure wave reflects against the walls of the pressure chamber 3 as well as against the nozzle orifice 4*b*. In accordance with the acoustic properties of the pressure chamber 3, the nozzle channel 4*a*, the nozzle orifice 4*b*, and the supply channel 2, the pressure wave will bounce back and forth and interfere with itself. This will take some time to dampen out, the time depending on the dampening properties of the fluid and the pressure chamber. If a second droplet is to be jetted sufficiently close after the first droplet, the existing pressure oscillations in the pressure chamber 3 will interfere with the pressure wave generated for jetting the second droplet. This will negatively impact on the timing of the jetting of the second droplet and the velocity with which the second droplet is jetted. In order to mitigate this negative impact, it is well known to actuate the actuator 5 with an extra pulse that contributes negatively to the oscillatory energy of the pressure wave in the pressure chamber 3. This extra pulse is known as a quench pulse. The quench pulse is the negative pulse in FIG. 3 that starts before the 15 μs mark and ends before the 20 μs mark. The timing and amplitude of the quench pulse is chosen in accordance with the pressure chamber acoustic properties such that the actuation of the actuator 5 by the quench pulse substantially counters the pressure oscillation in the pressure chamber 3.

Note that due to the oscillations in the pressure chamber 3, after a droplet has been jetted and before it has been sufficiently quenched, one or more smaller droplets may be expelled through the orifice 4*b* after the main droplet has been jetted without any further jetting pulses. These smaller droplets are known as satellite. In this document jetting a main droplet and one or more satellite droplets is considered to be the jetting of a single droplet.

Figure 3:
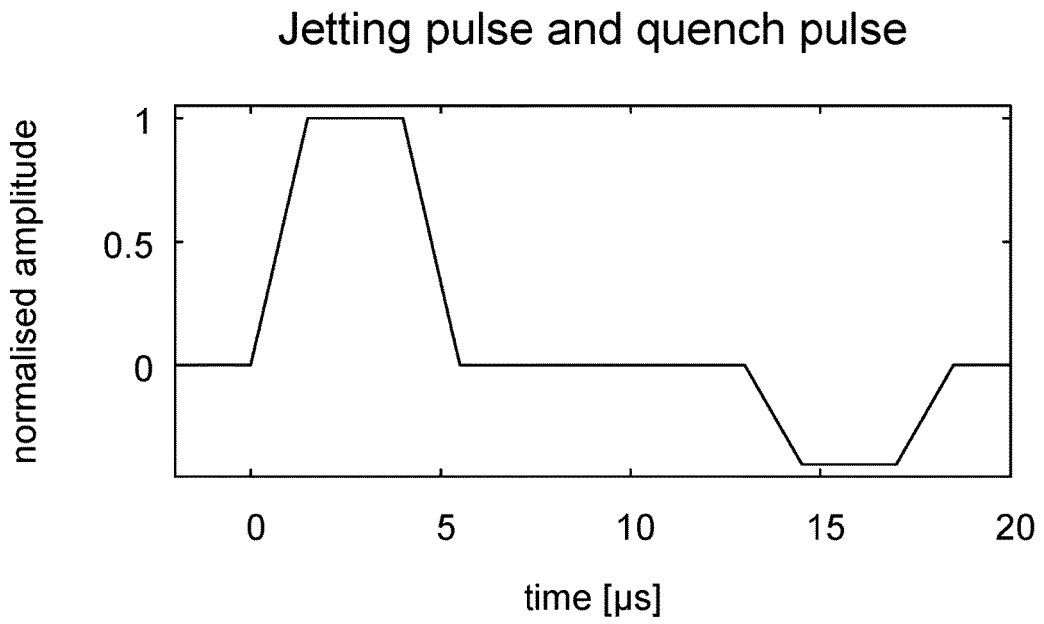
FIG. 3 shows a waveform for a driving signal for the actuator of FIG. 2 for jetting a single droplet of fluid.

Note that the amplitudes in FIG. 3 and the following figures are normalised. Furthermore, the amplitudes of the jetting pulse and the quench pulse do not necessarily have the correct ratio. The exact ratio depends on the damping the pressure wave experiences in the pressure chamber 3 and the interferences that occur in the pressure chamber 3. A typical ratio is that the amplitude of the quench pulse is approximately 40% of the amplitude of the jetting pulse.

Furthermore, the actual amplitudes of the pulses may vary to some degree. For example, when a 'wild' bitmap is printed, id est a bitmap with many shorter sequences of consecutive dots, the sequences being of varying lengths, the jetting velocity of the droplets will vary notably if all the droplets are jetted with pulses with the same amplitude and pulse width. This results in poor image quality due to inaccurate dot placement. In order to address this, it is known to apply a compensation algorithm that slightly varies the individual pulses either by varying the pulse amplitude, or the pulse width, or both. This results in uniform droplet velocities even in 'wild' bitmaps and therefore a high image quality. This compensation is known as 'bitmap tuning'.

Figure 4:
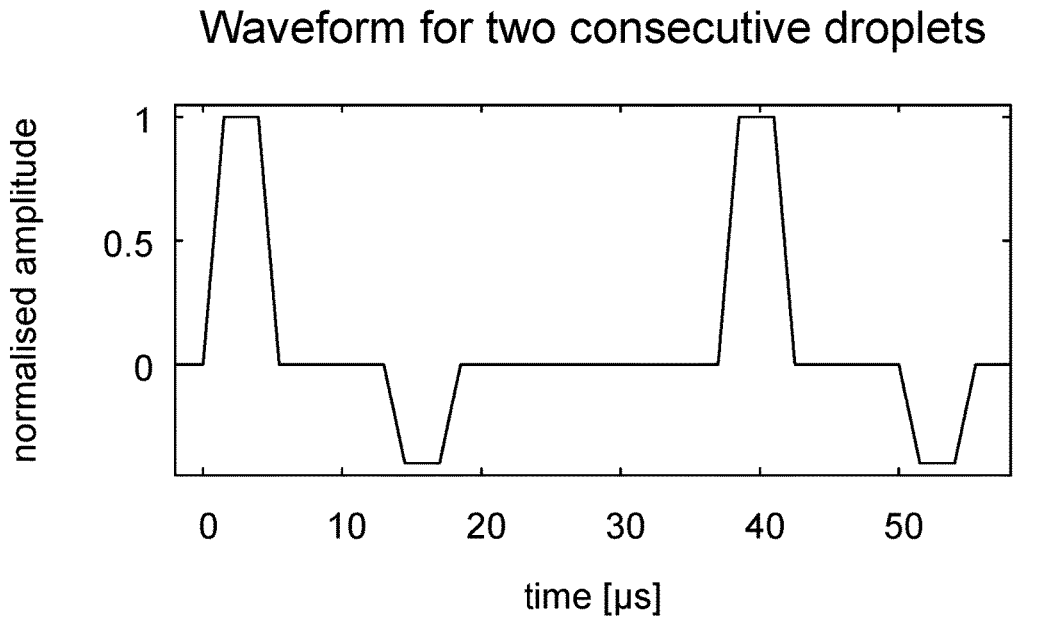
FIG. 4 shows a waveform comprising two periods for jetting two droplets consecutively according to a first timing.

FIG. 4 shows a waveform comprising two periods in order to jet two droplets in succession. After the first jetting pulse, the first quench pulse suppresses the oscillatory energy in the fluid in the pressure chamber 3. Then shortly before the 40 μs mark the second jetting pulse is generated in order to cause a second droplet to be jetted. Similarly to the first droplet, a quench pulse succeeds the jetting pulse for the second droplet in order to substantially cancel the oscillatory movements of the fluid in the pressure chamber 3.

Figure 5:
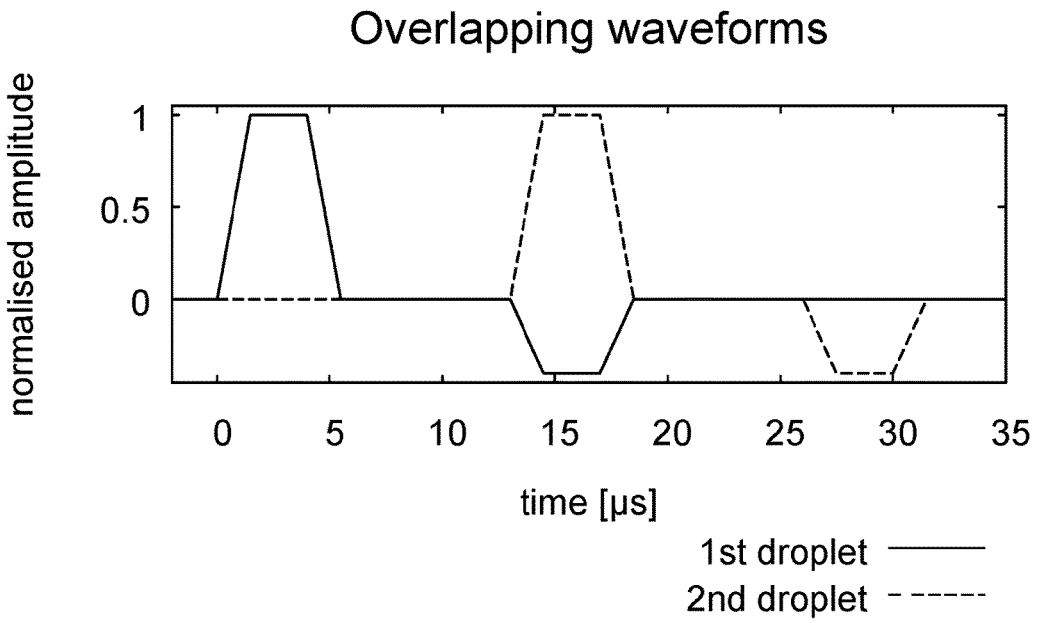
FIG. 5 shows two waveforms for jetting two droplets consecutively according to a second timing.

According to the invention it is advantageous though to start the jetting pulse for the second droplet earlier. The quenching action of the quench pulse for the first droplet and the jetting pulse for the second droplet may be combined by having them overlap in time. FIG. 5 shows the waveform for the first droplet (solid line) and the waveform for the second droplet (dashed line). Both waveforms have substantially the same shape. The second waveform, for the second droplet, is shifted in time such that the quench pulse of the first waveform and the jetting pulse of the second waveform overlap. In FIG. 5 the start of the leading edge of both pulses even coincide, as well as the end of the leading edges, and the start and end of the trailing edges.

Figure 6:
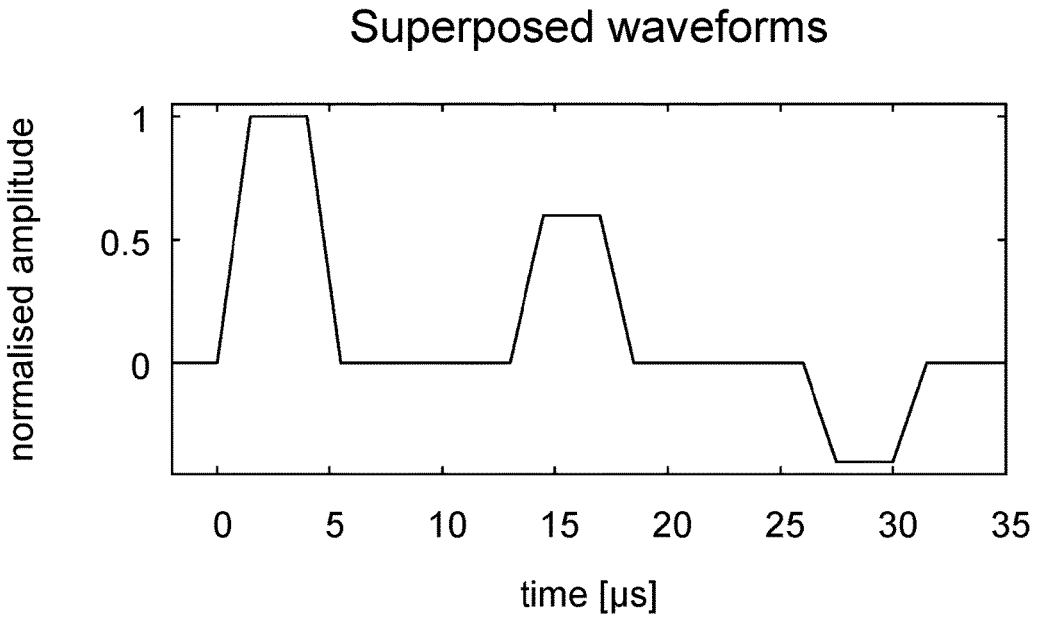
FIG. 6 shows a single waveform combining the two waveforms of FIG. 5.

By combining these two individual waveforms into a single waveform the waveform of FIG. 6 is obtained. The two individual waveforms are combined by addition. The resulting waveform shows a first jetting pulse from time mark 0 till slightly after time mark 5 μs. Then running from shortly before the 15 μs time mark until shortly before the 20 μs time mark a combined quench pulse and jetting pulse is generated. This combined pulse is lower than the jetting pulse for the first droplet as the quench pulse for the first droplet has contributed negatively to the jetting pulse for the second droplet. Lastly, after the 25 μs mark a normal quench pulse for the second droplet starts and ends shortly after the 30 μs mark.

Experiments have shown that the variation in the jetting velocity and the timing of the jetting of the second droplet is significantly better in the case of the combined jetting and quench pulse compared to jetting without any quench pulses, and only marginally smaller compared to the case that the second jetting pulse occurs after the first quench pulse (as shown in FIG. 4). Meanwhile it allows for jetting frequencies as high as when jetting without quench pulses, namely 78 kHz in the preferred embodiment. Combining a quench pulse with a subsequent jetting pulse (FIG. 6) therefore significantly increases the jetting frequency (78 kHz instead of 53 kHz) and therewith the productivity of the device compared to a second jetting pulse occurring after the first jetting pulse (FIG. 4), while only resulting in a marginally higher variation in jetting speed and jetting timing (which translates to print quality in jetting ink in a print head).

In addition to a higher productivity in the 78 kHz mode compared to the 53 kHz mode, the preferred embodiment generally consumes less power when operating in the 78 kHz mode (combining quench pulses with jetting pulses). In the 53 kHz mode the power consumption is more or less linear with the print coverage. The power consumption in the 78 kHz mode does not increase linear with the print coverage. Up till approximately 50% coverage, the power consumption in the 78 kHz mode follows the power consumption in the 53 kHz mode albeit at a slightly higher level. However, around 50% print coverage the power consumption starts to level off with increasing print coverage. (At 50% print coverage the power consumption is approximately 15 W in both 53 kHz mode and 78 kHz mode for a 256 nozzle print head with 4 ASICs and operated at 42 V maximum pulse voltage printing a random bitmap with the stated print coverage). Above 50% print coverage the power consumption in the 53 kHz mode keeps on increasing more or less linearly reaching 27 W at 100% print coverage, while the power consumption in the 78 kHz mode always stays below 17.6 W.

So for printing typical text documents (typically less than 50% print coverage), the 53 kHz mode (separate quench and jetting pulses) consumes slightly less power, however at a much lower productivity. For typical graphical applications (typically more than 50% print coverage), the 78 kHz mode is not only more productive, but is also more energy efficient.

Figure 7:
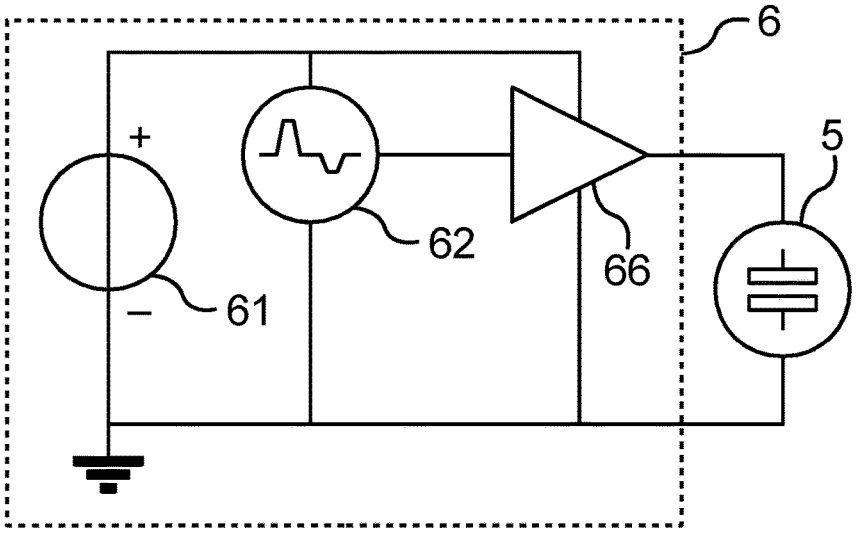
FIG. 7 shows a generic diagram of a drive voltage source for driving the actuator of FIG. 2.

The combined quench pulse and jetting pulse may be generated in various ways. The prototype built by applicant used a software implementation for generating various waveforms for separate quench pulses and jetting pulses as well as combined quench and jetting pulses. However, below some simplified hardware implementations are provided for illustrative purposes. FIG. 7 first shows a generic schematic of the drive voltage source 6 and the piezo actuator 5. The piezo actuator 5 behaves electrically more or less as a capacitance. Therefore, the piezo actuator 5 is denoted as a circle with the symbol of a capacitance inside. The drive voltage source 6 is driven by a DC power supply 61. The power supply 61 is shown as being internal to the drive voltage source 6, but may as well be external to the drive voltage source 6. The drive voltage source 6 further comprises a waveform generator 62 by means of dedicated circuitry. The waveform generated by the waveform generator 62 is fed to a driver 66 that actually drives the piezo actuator 5.

In the particular case of a print head for an inkjet printer, the waveform generator 62 may be implemented for each individual piezo actuator 5 of the print head. However, in an alternative implementation only a single, central, waveform generating device is employed and switching circuitry is used to feed the waveform only to those piezo actuators 5 that need to jet at a particular moment in time.

Figure 8:
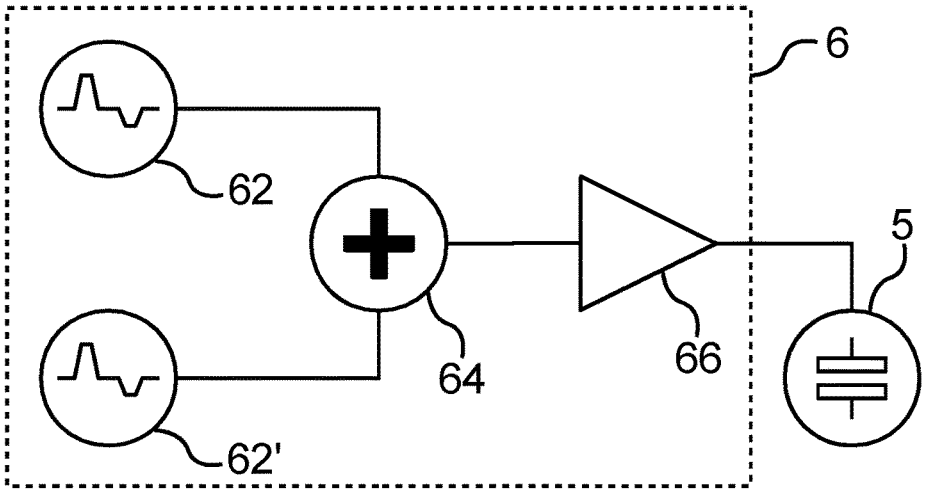
FIG. 8 shows a diagram of a generator for generating the waveform of FIG. 6.

FIG. 8 shows a more specific schematic for generating a waveform with a combined quench pulse and jetting pulse. For the sake of brevity and clarity, the power supply 61 and related components such as power supply lines have been omitted from FIG. 8. A first waveform generator 62 generates a first waveform for jetting a first droplet. The first waveform comprises a jetting pulse for jetting the first droplet of fluid as well as a quench pulse to suppress the liquid oscillations in the pressure chamber 3 after the first droplet has been jetted. A second waveform generator 62' generates a second waveform for jetting a second droplet. The second waveform also comprises a jetting pulse and a quench pulse, but now for jetting the second droplet respectively suppressing the oscillations in the pressure chamber 3 due to the jetting of the second droplet. The two waveform generators 62 and 62' are timed such that the quench pulse of the first waveform overlaps with the jetting pulse of the second waveform. The output of the two waveform generators 62 and 62' is supplied to a summing device 64 such as a summing amplifier. The summing device 64 produces a signal that is the summation of the first and second waveform. The two inputs of the summing device 64 are the two waveforms as shown in FIG. 5. The output of the summing device 64 is a waveform such as shown in FIG. 6. The output of the summing device 64 is, just like in the generic case depicted in FIG. 7, fed to a driver 66 to drive the piezo actuator 5.

The embodiment in FIG. 8 is well suited to jet sequences of droplets wherein the waveform generators 62 and 62' alternate for generating the jetting pulse and quench pulse for the droplets, allowing for overlapping every quench pulse of one waveform generator by a jetting pulse of the other waveform generator.

Figure 9:
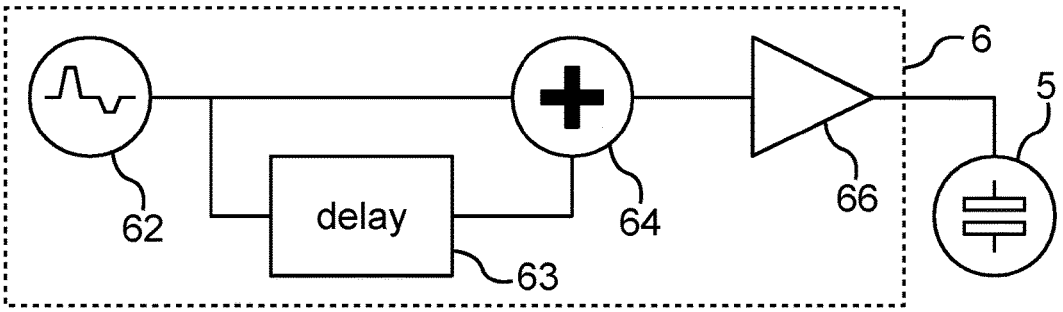
FIG. 9 shows a diagram of an alternative generator for generating the waveform of FIG. 6.

An alternative to the embodiment in FIG. 8 is depicted in FIG. 9. In this case the drive voltage source 6 comprises a single waveform generator 62 for the first and second droplet. The waveform for the second droplet is obtained by using a delayed copy of the waveform for the first droplet. To that end, the signal of the waveform generator 62 is fed to a delay 63. The delayed, second waveform that is output by the delay 63 is fed to the summing device 64 where the delayed, second waveform is added to the first waveform as obtained directly (undelayed) from the waveform generator 62. The delay time of the delay 63 is chosen such that the jetting pulse in the second waveform overlaps with the quench pulse of the first waveform, for example by using the time duration between the rising edge of the jetting pulse and the rising edge of the quench pulse as delay time.

Figure 10:
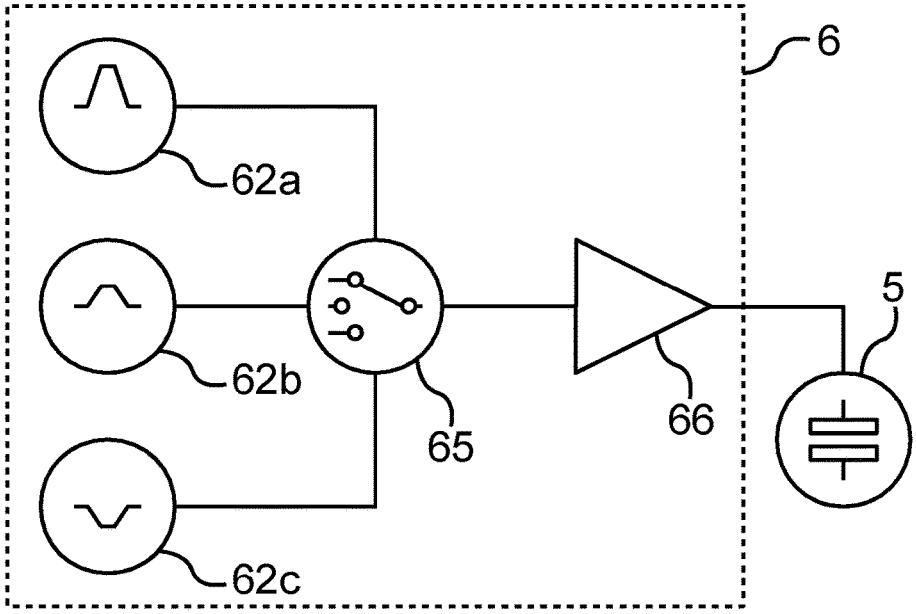
FIG. 10 shows a diagram of another alternative generator for generating the waveform of FIG. 6.

A further alternative is shown in FIG. 10. In this embodiment three waveform generators 62*a*, 62*b*, and 62*c* generate three different pulses, namely respectively a normal jetting pulse, a combined quench and jetting pulse, and lastly a normal quench pulse. The waveform generators 62*a-c* feed their signals to a switch 65. Depending on whether a jetting pulse, a quench pulse, or the combination of a jetting and a quench pulse is required the switch 65 selects the correct waveform generator 62*a*, 62*b*, or 62*c*. For example, to jet two consecutive droplets, the waveform as shown in FIG. 6 is to be generated. In order to do so, the switch 65 switches before or at the 0 time mark to waveform generator 62*a* that generates the normal jetting pulse. In the time period after the first pulse, but before the second pulse, for example at the 10 μs time mark, the switch 65 switches to waveform generator 62*b* to propagate the combined quench and jetting pulse. Then in the time period after the second pulse and before the third pulse is to be generated, for example at the 20 μs time mark, the switch 65 switches to the third waveform generator 62*c* in order to propagate the normal quench pulse. The exact timing of switching from one waveform generator to another generator is not significant as long as both waveform generators generate the same value at the moment of switching (0 Volt in the depicted examples).

Similar to the previous embodiments, the output of the switch 65 is fed to the driver 66 which drives the piezo actuator 5.

An alternative to the embodiment of FIG. 10 does not switch by switching the output, but uses waveform generators similar to the waveform generators 62*a-c*. These alternative versions normally produce a zero-valued output, and only output a pulse when triggered by a trigger input. The outputs of the waveform generators are combined by a summing device 64. Normally, the waveform generators output 0 Volt and therefore, the summing device 64 outputs 0 Volt. However, by sending a trigger to the trigger input of the appropriate waveform generator a normal jetting pulse, a combined quench and jetting pulse, or a normal quench pulse is generated. In this case, the waveform generator for the combined quench and jetting pulse can even be omitted by triggering the waveform generators for the jetting pulse and for the quench pulse simultaneously, or even only close in time if the rising edges do not need to coincide exactly.

The earlier remark on a waveform generator for each individual piezo actuator 5 versus a single, central, waveform generator with accompanying switching circuitry applies to the embodiments in FIGS. 8-10 too.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims is herewith disclosed. Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A fluid jetting device comprising:

a nozzle plate;

a fluid chamber terminating in an orifice in the nozzle plate;

an actuator for generating a pressure wave in a fluid in the fluid chamber to jet fluid through the orifice from the chamber;

a jetting waveform generating device connected to the actuator for generating an excitation waveform comprising two separated pulses, called a jetting pulse and a quenching pulse, the jetting pulse for generating a pressure wave in the fluid in the fluid chamber leading to a fluid droplet, the quenching pulse for substantially cancelling a pressure wave in the fluid in the fluid chamber;

wherein the jetting waveform generating device is adapted to make, when jetting two consecutive fluid droplets, a first and a second droplet, the jetting pulse of the second droplet at least partially overlap the quenching pulse directly following the jetting pulse of the first droplet.

2. The fluid jetting device according to claim 1, wherein, when jetting two consecutive fluid droplets, the jetting pulse of the second droplet substantially coincides with the quenching pulse directly following the jetting pulse of the first droplet.

3. The fluid jetting device according to claim 1, wherein:

the leading edge of the quenching pulse directly following the jetting pulse of the first droplet substantially coincides with the leading edge of the jetting pulse of the second droplet, and/or the trailing edge of the quenching pulse directly following the jetting pulse of the first droplet substantially coincides with the trailing edge of the jetting pulse of the second droplet.

4. The fluid jetting device according to claim 1, wherein:

the leading edge of the quenching pulse directly following the jetting pulse of the first droplet occurs before the leading edge of the jetting pulse of the second droplet, and the trailing edge of the quenching pulse directly following the jetting pulse of the first droplet occurs after the trailing edge of the jetting pulse of the second droplet.

5. The fluid jetting device according to claim 1, wherein the jetting pulse comprises multiple sub-pulses, each sub-pulse contributing positively to the oscillatory energy of the fluid in the fluid chamber and the last sub-pulse causing the actual jetting of fluid through the orifice from the chamber.

6. The fluid jetting device according to claim 1, wherein the jetting waveform generating device comprises a jetting pulse generator and a quench pulse generator, and wherein the jetting waveform generating device is configured to generate a combined quenching pulse in a first excitation waveform and jetting pulse in a second excitation waveform by superimposing a quenching pulse from the quench pulse generator and a jetting pulse from the jetting pulse generator.

7. The fluid jetting device according to claim 1, wherein the fluid jetting device comprises a print head.

8. A printer apparatus comprising the print head according to claim 7.

9. The printer apparatus according to claim 8, wherein the jetting waveform generating device is external to the print head, and wherein an excitation waveform generated and output by the jetting waveform generating device is input to the print head that is connected to the jetting waveform generating device.

10. The printer apparatus according to claim 8 that is operable in at least two operational modes with different print speeds:

a first operational mode, being a high speed mode, wherein, when jetting two consecutive fluid droplets, the jetting pulse of a second excitation waveform at least partially overlaps the quenching pulse of a first excitation waveform; and a second operational mode, having a lower print speed than the first operational mode, wherein, when jetting two consecutive fluid droplets, the jetting pulse of a second excitation waveform starts after the quenching pulse of a first excitation waveform is finished.

11. A method for controlling a process of jetting a fluid droplet from a fluid jetting device, the fluid jetting device comprising a nozzle plate, a fluid chamber terminating in an orifice in the nozzle plate, an actuator for generating a pressure wave in a fluid in the fluid chamber leading to a fluid droplet from the orifice of the fluid chamber and a jetting waveform generating device connected to the actuator for generating an excitation waveform comprising two separated pulses, called a jetting pulse and a quenching pulse, the jetting pulse for generating a pressure wave in the fluid in the fluid chamber leading to a fluid droplet and the quenching pulse for substantially cancelling a pressure wave in the fluid in the fluid chamber, the method comprising the steps of: 1) determining a timing between two consecutive fluid droplets; 2) if the timing is smaller than a predetermined threshold, generating a first excitation waveform for a first fluid droplet and a second excitation waveform for a second fluid droplet, wherein the jetting pulse of the second excitation waveform at least partially overlaps the quenching pulse of the first excitation waveform; 3) otherwise, generating a first excitation waveform for a first fluid droplet and generating a second excitation waveform for a second fluid droplet after finishing the first excitation waveform.

12. The method according to claim 11, wherein in step 2 the jetting pulse of the second excitation waveform substantially coincides with the quenching pulse of the first excitation waveform.

13. The method according to claim 11, wherein in step 2 the leading edge of the quenching pulse of the first excitation waveform occurs before the leading edge of the jetting pulse of the second excitation waveform, and the trailing edge of the quenching pulse of the first excitation waveform occurs after the trailing edge of the jetting pulse of the second excitation waveform.

14. The method according to claim 11, wherein the jetting waveform generating device comprises a jetting pulse waveform generator and a quench pulse waveform generator, and wherein in step 2 the method further comprises the step of superimposing the jetting pulse of the second excitation waveform and the quenching pulse of the first excitation waveform, thereby generating a combined jetting and quenching pulse.

* * * * *